US005175139A

United States Patent [19]

Nakamura et al.

[11] Patent Number: 5,175,139

[45] Date of Patent: Dec. 29, 1992

[54] METHOD OF HEAT TRANSFER PRINTING AND HEAT TRANSFER SHEET

[75] Inventors: Masayuki Nakamura; Katsuyuki Oshima; Jitsuhiko Ando, all of Tokyo, Japan

[73] Assignee: Dai Nippon Insatsu Kabushiki Kaisha, Japan

[21] Appl. No.: 474,108

[22] PCT Filed: Aug. 29, 1989

[86] PCT No.: PCT/JP89/00878

§ 371 Date: Apr. 30, 1990

§ 102(e) Date: Apr. 30, 1990

[87] PCT Pub. No.: WO90/02048

PCT Pub. Date: Mar. 8, 1990

[30] Foreign Application Priority Data

Aug. 31, 1988 [JP] Japan ..... 1-217582
Jul. 14, 1989 [JP] Japan ..... 63-180474

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,021,591 5/1977 De Vries et al. ..... 428/200

FOREIGN PATENT DOCUMENTS 0041587 4/1978 Japan ..... 8/471
54-91243 7/1979 Japan ..... 503/227
0223380 12/1984 Japan ..... 8/471
61-31273 2/1986 Japan ..... 503/227
1130100 6/1986 Japan ..... 503/227
61-162388 7/1986 Japan ..... 503/227
62-62793 3/1987 Japan ..... 503/227
62-104787 5/1987 Japan ..... 503/227

*Primary Examiner*—Bruce H. Hess
*Attorney, Agent, or Firm*—Parkhurst, Wendel & Rossi

[57] ABSTRACT

In a heat transfer sheet wherein an image of a dye layer (2a, 2b, 2c and 2x) is transferred to an image receiving sheet (11), such as a card, according to an image signal applied to the dye layers (2a, 2b, 2c and 2x) by thermal heads, the dye layer is applied to only a specific local area of a substrate film (1) corresponding to an area of the image receiving sheet in which the image is to be formed. Accordingly, the dye layer is not caused to contact the area of the image receiving sheet (11) where the transferred image is not present, and a field contamination produced in the peripheral portion of the transferred image is prevented. In addition, the dye layer is locally provided whereby the dye layer is saved. A protective layer (2p) to be transferred to the surface of the image on the image receiving sheet (11) can be provided on the heat transfer sheet. The protective layer (2p) imparts resistance to wear and resistance to contamination to the transferred image on the image receiving sheet (11).

25 Claims, 4 Drawing Sheets

METHOD OF HEAT TRANSFER PRINTING AND HEAT TRANSFER SHEET

TECHNICAL FIELD

The present invention relates to a method of heat transfer printing and a heat transfer sheet for use in the method, and more particularly to an improvement in a method of heat transfer printing in which an image signal is transmitted by a thermal head to a heat migratable dye layer on one surface of a heat transfer sheet, and the heat transfer sheet is pressed against a sheet to which the image is to be printed to heat-migrate the image of the dye of the dye layer to the sheet to which the image is to be printed, and to an improved heat transfer sheet used for the method.

BACKGROUND ART

A method of heat transfer printing and a heat transfer sheet of this kind are disclosed, for example, in U.S. Patent No. 4,650,494. According to this method of heat transfer printing, an excellent monocolor or multicolor image can be formed simply and at high speed on an image receiving sheet to which the image is to be printed, and it is possible to obtain a multicolor image having particularly excellent continuous tone and equal quality to that of a color photograph. The heat transfer sheet to be used for the method of heat transfer printing of this kind is designed so that a dye layer having substantially the same size as the entire shape of the sheet to which the image is to be printed (that is, always constant size irrespective of the size, shape or the like of a portion on which the transferred image is formed) is provided on a substrate film.

However, in the conventional heat transfer sheet, in the case where an image is transferred to an image receiving sheet wherein a portion on which the transferred image is formed is located in a part of the surface of the image receiving sheet (in other words, the image forming portion is disposed locally), the dye layer of the heat transfer sheet is used only for a portion corresponding to the aforesaid image forming portion and other dye layer portions are not used. This is uneconomical, and in addition, the peripheral portion of the formed transferred image is contaminated by the unused portion of the dye layer.

The present invention has been accomplished in order to overcome the aforementioned problem. It is an object of the present invention to provide a method of heat transfer printing, which can minimize occurrence of a wasteful dye layer portion even when the image is transferred to the image receiving sheet whose image forming portion is disposed locally, and the peripheral portion of the transferred image is not contaminated. The present invention further provides a heat transfer sheet used for the method.

DISCLOSURE OF THE INVENTION

According to the present invention, there is provided a method of heat transfer printing in which a heat transfer sheet is provided which comprises a substrate film and heat migratable dye layers of at least one color, provided on one surface of said substrate film, the dye layer of the heat transfer sheet is heated according to an image signal, and the heat transfer sheet is pressed against a printing sheet to which an image is to be printed to heat-migrate the image of the dye of the dye layers to the printing sheet, characterized in that each of the dye layers is provided in a specific local area of the substrate film, corresponding to a local area of the printing sheet in which the image is to be formed, and the dye of the dye layers is migrated to the local area of the printing sheet.

According to another aspect of the present invention, there is provided a heat transfer sheet in which heat-migratable dye layers of at least one color are provided in a spaced relation on one surface of a substrate film, characterized in that the dye layers are provided in a specific local area of the substrate film corresponding to a local area of a printing sheet in which an image is to be formed.

BEST MODE FOR CARRYING OUT THE INVENTION

Embodiments of the present invention will be described with reference to the drawings.

Figure 1:
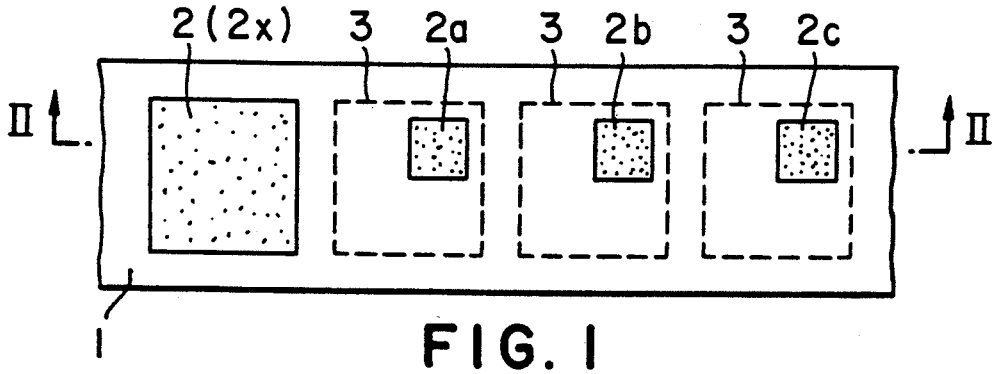
FIG. 1 is a plan view showing one embodiment of a heat transfer sheet according to the present invention.
Figure 2:
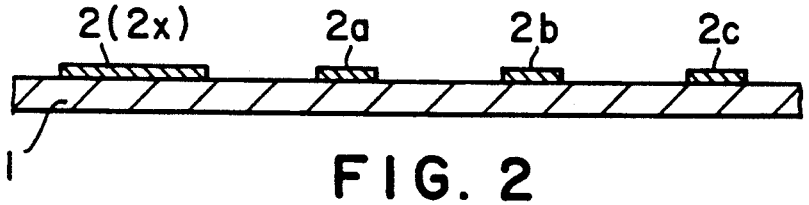
FIG. 2 is a sectional view taken on line II—II of FIG. 1.

The heat transfer sheet used for the method of heat transfer printing according to the present invention is composed of a substrate film 1 and a dye layer 2 provided on one surface of the substrate film 1 as shown in FIGS. 1 and 2. In FIG. 1, reference numeral 3 designates an area of one pitch portion of transfer printing. In the transfer sheet heretofore used, a dye layer is applied to the whole area 3. That is, even in a case where a local image such that only a part of the area 3 may be used for the transfer printing is formed on an image receiving sheet to which the image is to be printed, the dye layer is applied to the whole area 3. On the other hand, in the present invention, dye layers 2*a*, 2*b*, 2*c*, etc. are provided in specific local areas of the substrate film 1, corresponding to areas of the image receiving sheet in which transferred images are to be printed. The local area of each of the dye layers 2*a*, 2*b* and 2*c* corresponds to a face-photograph portion 15 which is present only in a part of an ID card S as a printing sheet shown in FIG. 17, for example. If the face-photograph portion 15 is a color gradation part such as a color photograph, the dye layers 2*a*, 2*b* and 2*c* are sublimable dye layers, for example, of cyan, magenta and yellow.

Figure 17:
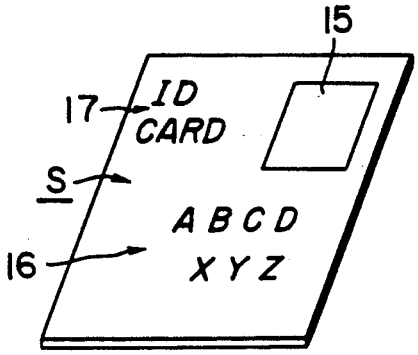
FIG. 17 is a perspective view showing one example of an ID card.

The ID card S as the image receiving sheet can be sometimes formed with character portions as monotonic image portions 16 and 17 other than the face-photograph portion 15, as shown in FIG. 17. Another dye layer 2x can be provided for the transfer printing of these monotonic image portions 16 and 17. In this example, the dye layer 2x is provided over the whole area of one pitch portion and can be of a sublimable dye layer of black, for example.

Figure 3:
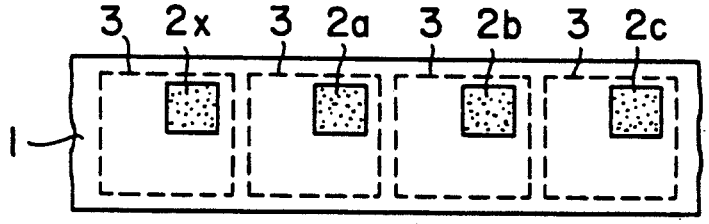
FIGS. 3 to 6 are respectively plan views showing different embodiments of the heat transfer sheet according to the present invention.

In the embodiment shown in FIG. 3, the dye layer 2x is provided in the same local area as other dye layers 2a, 2b and 2c. This dye layer 2x is, for example, a sublimable dye layer of black. In the case where the transferred image is formed on the surface of a card such as an ID card, the card substrate is thick and hard, and therefore, pressure applied to the card substrate must be increased in order to color the image with high density. However, when the dye layer is provided over the whole area of one pitch portion of the substrate film as in the conventional case, the applied pressure acts also on a portion where image is not present, and a stain tends to occur in the peripheral portion of the transferred image. According to this embodiment, since no dye layer is present in a portion where an image is not present, the stain is never produced.

Figure 4:
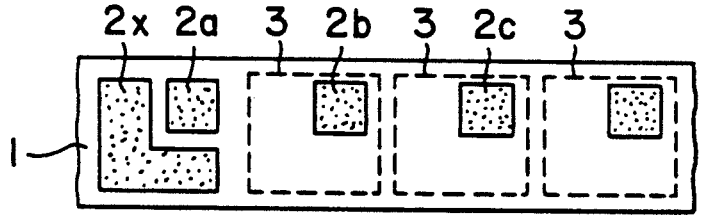

In the embodiment shown in FIG. 4, the dye layer 2x comprises, for example, a hot melt ink, which is provided in an area not superimposed to dye layers for gradation image portions 2a, 2b and 2c, for the transfer printing of only monotonic image portions (character portions) other than the gradation image portion.

Figure 5:
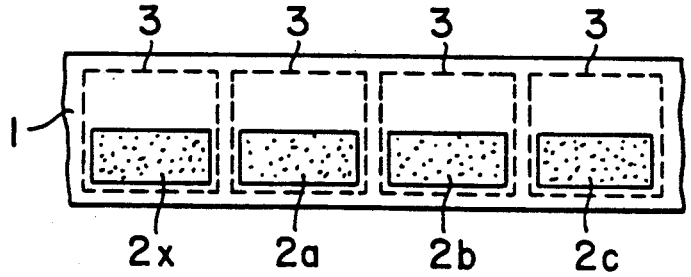

In the embodiment shown in FIG. 5, all of the dye layers 2a, 2b, 2c and 2x are provided in the same local areas similarly to the case of FIG. 3, which are however different from the FIG. 3 embodiment in location, size and shape occupied within an area of one pitch portion. In the above-described embodiments, the dye layer 2x may be of a color other than black.

The substrate film 1 may be any of those which have been heretofore used as a substrate of the heat transfer sheet. For example, paper, various converted paper, polyester film, polystyrene film, polypropylene film, aramide film, polycarbonate film, polyvinyl alcohol film, cellophane, etc. can be used. The substrate film may be subjected to heat resistance treatment and other treatments, if necessary.

The dye layer 2 is a layer in which the heat migratable dye is carried by suitable binder resins. The above-described dyes can be used in the present invention if they are dyes used for the well-known heat transfer sheets and the dyes used are not particularly restrictred. As some preferable dyes, for example, magenta dyes include MS Red G (Disperse Red 60, product name of MITSUI TOATSU SENRYO K.K.), Macrolex Red Violet R (Disperse Violet 26, product name of BAYER AG), Ceres Red 7B (Solvent Red 19, product name of BAYER AG), Samaron Red HBSL (product name of HOECHST AG.), SK Rubine SEGL K.K.), Bymicron SN VP 2670 (product name of BAYER AG), Resoline Red F3B5S (product name of BAYER AG), and the like; yellow dyes include Foron Brilliant Yellow S-6GL (product name of SANDOZ LTD.), PTY 52 (Disperse Yellow 141, product name of MITSUBISHI KASEI KOGYO K.K.), Macrolex Yellow 6G (Disperse Yellow 201, product name of BAYER AG), Terasil Golden Yellow 2RS (product name of CIBA-GEIGY LTD.) and the like; cyan dyes include Kayaset Blue 714 (solvent Blue 63, product name of NIPPON KAYAKU K.K.), Waxoline Blue AP-FW (solvent Blue, product name of ICI LTD.), Foron Brilliant Blue S-R (product name of SANDOZ LTD.), MS Blue 100 (product name of MITSUI TOATSU SENRYO K.K.), Daito Blue No. 1 (product name of DAITO KAGAKU K.K.), and the like.

As the binder resins for carrying the dyes as described above, any of well known materials may be used. For example, there can be mentioned cellulose resins such as ethyl cellulose, hydroxycellulose, ethyl hydroxy cellulose, hydroxy propyl cellulose, methyl cellulose, acetic cellulose, butyrate cellulose, etc., and vinyl resins such as polyvinyl alcohol, polyvinyl acetal, polyvinyl pyrrolidone, polyacrylamide, etc. Among them, polyvinyl butyral, polyvinyl acetal and the like are preferable in terms of heat resistance, heat migration and the like.

In the case where the image to be formed is of monocolor, the dye layer 2 can be formed along a predetermined forming pattern by selecting suitable one of colors out of the aforementioned dyes, and in the case where the image to be formed is of multicolor, a predetermined hue out of each of suitable cyan, magenta, yellow, and black is selected and suitably combined.

The thickness of the dye layer 2 is from 0.2 to 5.0 μm, preferably, from 0.4 to 2.0 μm. The proportion of the dye contained in the dye layer is from 5 to 90 weight % of the weight of the dye layer, preferably from 10 to 70 weight %.

The heat transfer sheet according to the present invention constructed as described above is advantageous in that when it is used for the transfer printing to the image receiving sheet wherein the transferred image forming area is localized, the dye layer can be effectively used without waste, and in that where a large amount of transfer printing is effected, the transfer sheet can be provided at low cost. Specific examples of such image receiving sheet include cards (such as ID cards, license cards, passports, bank-cards, prepaid cards, etc.), calling cards, tickets, etc.

Figure 6:
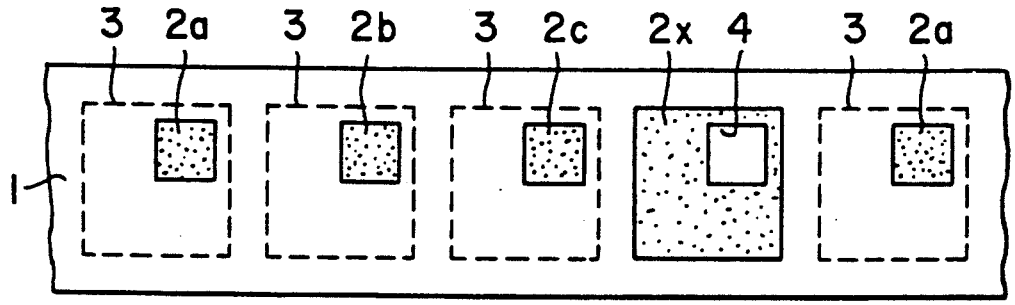

The embodiment shown in FIG. 6 is different from the embodiment of FIG. 1 in that the dye layer 2x is arranged after three dye layers 2a, 2b and 2c, and the dye layer 2x is provided with a colorless portion 4 of an area corresponding to those of the other dye layers 2a, 2b and 2c. In this embodiment, the dye layers 2a, 2b and 2c are sublimable dye layers of yellow, magenta and cyan, respectively, for example, and the dye layer 2x is a sublimable dye layer of black or a hot melt ink layer. When this heat transfer sheet was used to form a transferred image, no stain was found in the peripheral portion of the formed image, and in addition, the monotonic image portion (character portion) obtained by the dye layer 2x was clear. The clearness of the monotonic image portion was more excellent in the case where the dye layer 2x is a hot melt ink layer, and the image had a high concentration and was sharp.

Figure 7:
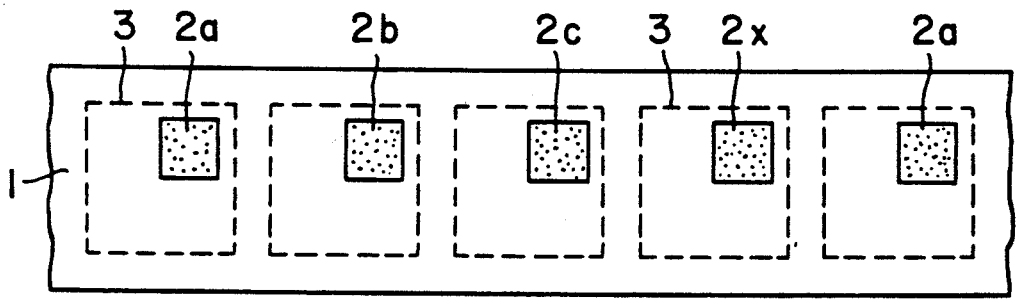
FIGS. 7 and 8 are respectively plan views of different heat transfer sheets for the purpose of comparison with the embodiment of FIG. 6.
Figure 8:
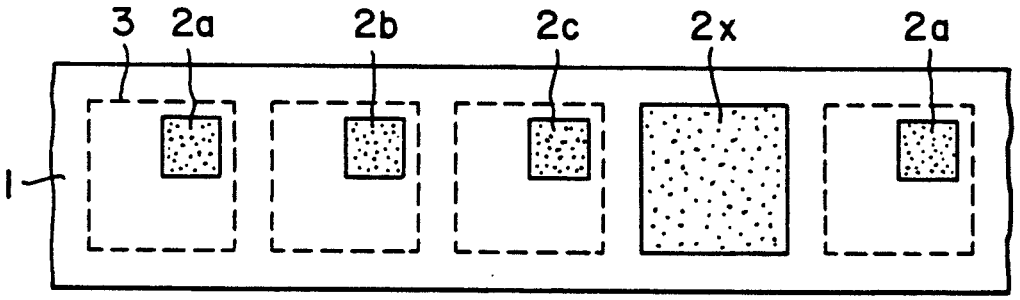

FIGS. 7 and 8 show examples which are relatively not desirable and which are merely provided for comparison with the embodiment shown in FIG. 6. In the FIG. 7 example, the dye layer 2x of black is provided at a position completely superimposed to other dye layers 2a, 2b and 2c, the dye layer 2x being comprised of a hot melt ink layer. In the FIG. 8 example, the dye layer 2x of black is provided on the whole area of one pitch portion including areas of the other dye layers 2a, 2b and 2c, the dye layer 2x being comprised of a hot melt ink layer. In the case where the dye layer of the hot melt ink and the dye layer of the sublimable dye are superimposed in the transfer area, the tone of the gradation image portion is inferior, in character and color balance, to the case where both the dye layers are not superimposed as shown in FIG. 6. Accordingly, it is desirable to provide the colorless portion 4 as shown in FIG. 6.

Figure 9:
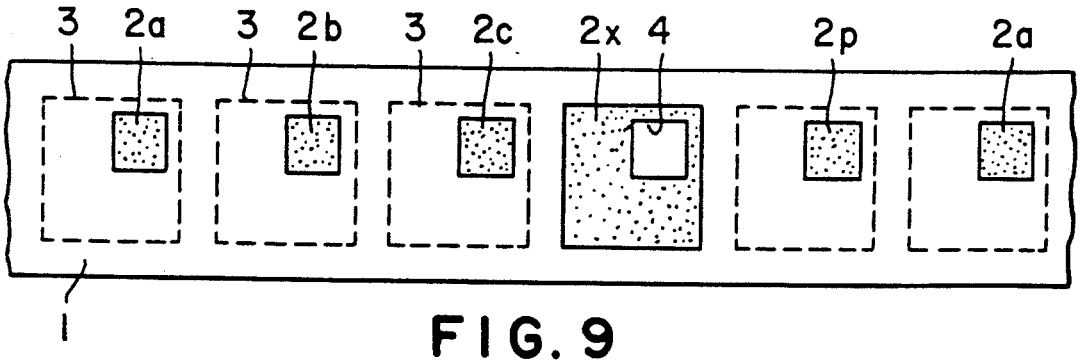
FIGS. 9 to 14 are respectively plan views showing further different embodiments of the heat transfer sheet according to the present invention.

The embodiment shown in FIG. 9 is different from the FIG. 6 embodiment in that a transfer protective layer 2p is provided in succession to the dye layer 2x of the hot melt ink. In this embodiment, the transfer protective layer 2p is provided in an area corresponding to the dye layers 2a, 2b and 2c. When this heat transfer sheet is used to transfer the image to the image receiving sheet, a protective layer is formed on the surface of the obtained gradation image, and the resistance to wear and resistance to contamination of the image are enhanced. The dye layer 2x which forms a monotonic image is joined to the substrate film 1 through a peeling layer (not shown), and after transferred to the surface of the image receiving sheet, the peeling layer migrates together with the dye to cover the surface of the image, thus functioning as a protective layer.

Figure 10:
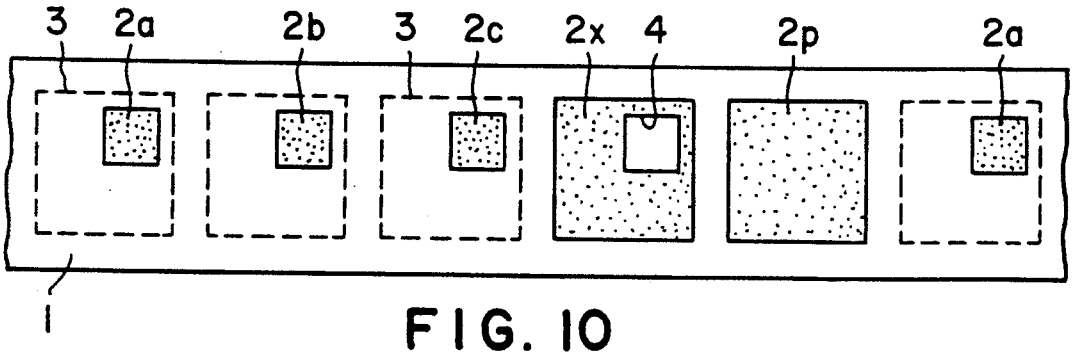

In the embodiment shown in FIG. 10, the transfer protective layer 2p is formed not in a local area as in FIG. 9 but over the whole area of one pitch portion. After transferred to the image receiving sheet, the protective layer 2p covers both the surface of the tonal image formed by the dye layers 2a, 2b and 2c and the surface of the monotonic image formed by the dye layer 2x to enhance the resistance to wear and resistance to contamination.

Figure 11:
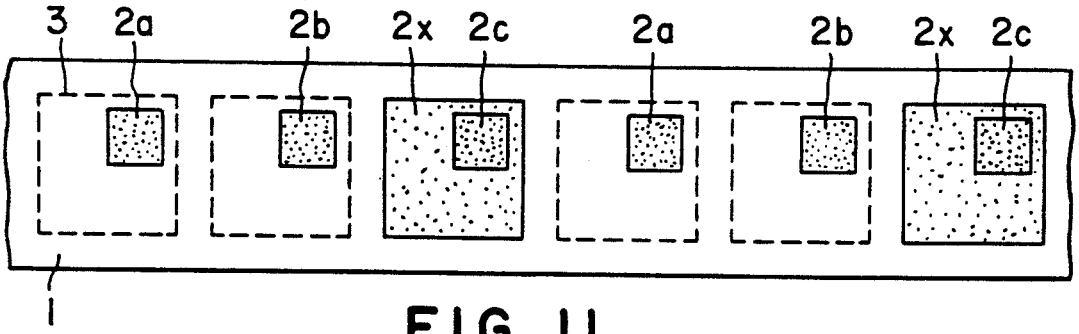

In the embodiment shown in FIG. 11, the dye layer 2x (for the monotonic image) of the hot melt ink is provided in a part of an area of one pitch portion where the sublimable dye layer 2cof cyan is present, instead of providing the dye layer (for the monotonic image) of the hot melt ink in an independent area of one pitch portion as in the FIG. 6 embodiment. Therefore, it is possible to shorten the length of the transfer sheet while possessing the same effect as that of the transfer sheet shown in FIG. 6. Therefore, this embodiment is economical.

Figure 12:
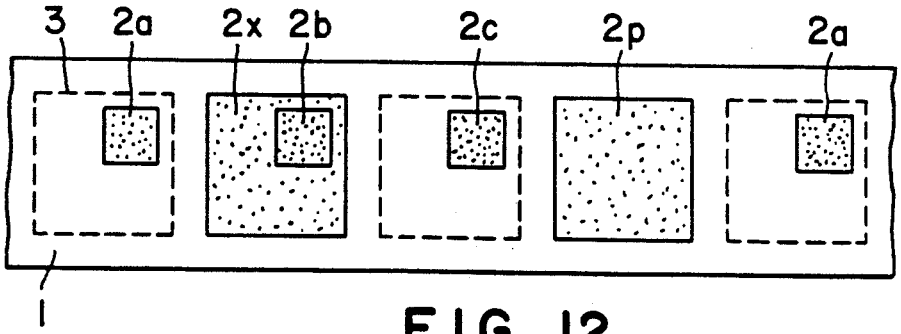

In the embodiment shown in FIG. 12, the dye layer 2x of the hot melt ink is provided in an area of the dye layer 2b of magenta instead of the area of the dye layer 2c. It is to be noted that similarly to the case of the FIG. 11 embodiment, a transfer protective layer 2p may be provided over the whole area of one pitch, by making use of one pitch length by which the length of the transfer sheet is shortened. It is obvious that the dye layer 2x can be also provided in the area of the dye layer 2a of yellow.

Figure 13:
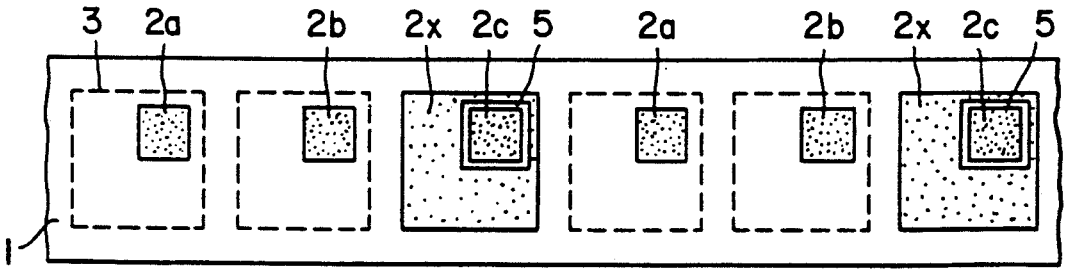

In the embodiment shown in FIG. 13, a frame-like marginal portion 5 is provided between the dye layer 2c of the sublimable dye and the dye layer 2x of the hot melt ink, in the transfer sheet shown in FIG. 11. By the provision of the marginal portion 5, it is possible to prevent a field contamination from being produced in the periphery of the gradation image formed by the dye layers 2a, 2b and 2c. Also in this embodiment, a transfer protective layer 2p can be further provided as shown in FIG. 12.

Figure 14:
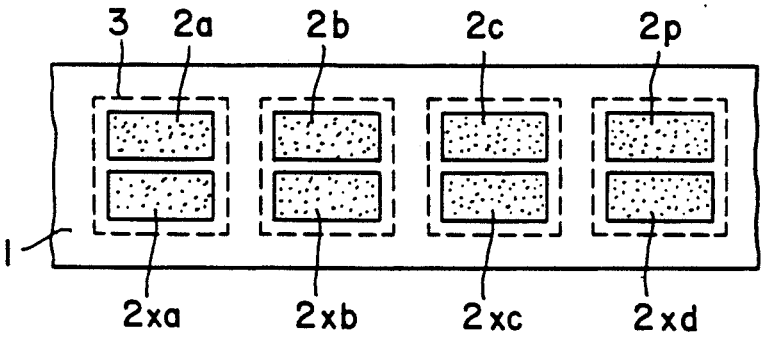

In the embodiment shown in FIG. 14, a yellow dye layer 2a, a magenta dye layer 2b and a cyan dye layer 2c which are formed of a sublimable dye are arranged in said order in an upper half portion of each area of one pitch portion, and a yellow dye layer 2xa , a magenta dye layer 2xb and a cyan dye layer 2xc which are formed of a hot melt ink are arranged in said order in a lower half portion of each area of one pitch portion. Then, a transfer protective layer 2p and a black dye layer 2xd of a hot melt ink are arranged in the upper half portion and lower half portion, respectively, of the area of one pitch portion in succession thereto. In this embodiment, a color gradation image protected by a protective layer is formed in the upper half portion of the image receiving sheet, and a color monotonic image (for example, a color character portion) is formed in the lower half portion thereof.

Figure 15:
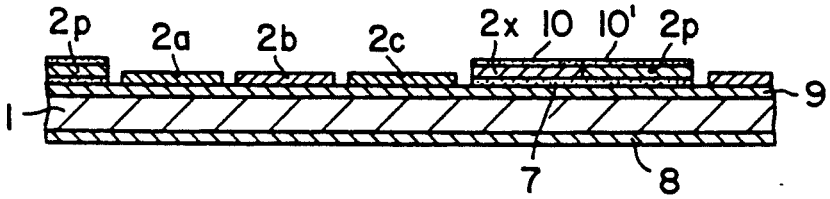
FIG. 15 is a sectional view of a still further embodiment of the heat transfer sheet according to the present invention.

FIG. 15 diagrammatically shows a section of a heat transfer film according to another embodiment of the present invention. In the heat transfer film of this embodiment, dye layers 2a, 2b and 2c of sublimable dye consisting of hue areas of yellow, magenta and cyan, a dye layer 2x of a black hot melt ink and a transfer protective layer 2p are formed in said order on the substrate film 1.

In FIG. 15, reference numeral 7 designates a peeling layer, which is provided to facilitate the transfer of the dye layer 2x of the hot melt ink and the transfer protective layer 2p . Reference numeral 8 designates a back heat resistant layer, which is provided to prevent a thermal head of a printer from being adhered. Reference numeral 9 designates a primer layer, which is provided to improve the adherence of the dye layers 2a, 2b and 2c of the sublimable dye and the peeling layer 7 to the substrate film 1. Reference numerals 10 and 10' designate adhesive layers. The adhesive layers 10 and 10' are provided to facilitate the transfer of the dye layer 2x of the hot melt ink and/or the transfer protective layer 2p . These layers 7 to 10 are not essentially required but in the case where the primer layer 9 is provided, the peeling layer 7 is preferably provided.

The thickness of the substrate film 1 can be suitably varied according to materials so as to have adequate strength, heat resistance and the like thereof, preferably, 3 to 100 μm.

As dyes used, any of dyes used for the conventional heat transfer film of the sublimable type can be effectively used and are not particularly limited.

The dye layer 2 is preferably formed by adding the aforementioned dyes, binder resins and other suitable components into a suitable solvent, dissolving or dispersing the components to prepare a dye layer forming ink, and printing and drying it on the substrate film 1 by gravure printing process or the like.

The hot melt ink for the dye layer 2x used in the present invention comprises a colorant and a vehicle. Various additives may be further added, as needed.

The colorants may be those having better characteristics as recording material among oraganic or inorganic pigments or dyes, preferably those which have sufficient coloring concentration and are not discolored and faded by light, heat, temperature and the like.

The vehicles used include those having wax as a main component, and a mixture of wax and derivatives of dry oil, resin, mineral oil, cellulose and rubber.

As the method for forming the dye layer 2x of the hot melt ink on the substrate film 1 or on the peeling layer 7 provided in advance on the substrate film 1, there is mentioned a method for coating the ink by use of hot melt coat, hot lacquer coat, gravure coat, gravure reverse coat, roll coat and many other means, and the like. The thickness of the ink layer to be formed should be determined in harmony with necessary concentration and heat sensitivity. For example, the thickness of the ink layer is preferably in the range from about 0.2 to 10 μm.

Preferably, the peeling layer 7 is formed on the surface of the substrate film prior to formation of the dye layer 2x of the hot melt ink. The peeling layer 7 is formed of peeling agents such as waxes mentioned before, silicon wax, silicon resin, fluoroplastics, acrylic resin, etc. The method of formation may be similar to the aforementioned method of forming the sublimable dye layer and the hot melt ink dye layer, and the thickness thereof is suffice to be approximately 0.1 to 5 μm. Further, in the case where delustered printing and delustered protective layer are desirable after the transfer printing, various kinds of particles can be contained in the peeling layer to form a matted surface. Inks for the peeling layer used may comprise the following compositions:

| | |
|---|---|
| Acrylic resin | 20 parts |
| Methylethyl ketone | 100 parts |
| Toluene | 100 parts |

The substrate film or the transfer protective layer 2p provided on the peeling layer is formed of resins excellent in transparency, resistance to wear, resistance to chemicals and the like, for example, such as acrylic resin, polyester resin, polyurethane resin and the like. The method of formation is to prepare a suitable resin solution and form it into a thickness of from 0.2 to 10 μm or so, for example, by use of the coating method or printing method as described above. Where these protective layers are formed, a filler such as silica or alumina in an amount not to impair the transparency can be added therein in order to facilitate a film cut during the heat transfer. One example of the composition of the ink for the transfer protective layer is as follows:

| | |
|---|---|
| Acrylic resin | 20 parts |
| Methylethyl ketone | 50 parts |
| Toluene | 50 parts |
| Polyethylene wax | 1 part |

The adhesive layers 10 and 10' are formed by coating and drying a resin solution excellent in adhesive properties, for example, such as acrylic resin, vinyl chloride resin, copolymer resin of vinyl chloride and vinyl acetate, polyester resin, etc., so as to have a thickness of preferably from 0.1 to 5 μm or so. One example of the composition of the ink for the adhesive layer is as follows:

| | |
|---|---|
| Copolymer of vinyl chloride and vinyl acetate | 10 parts |
| Methylethyl ketone | 100 parts |
| Toluene | 100 parts |

Figure 16:
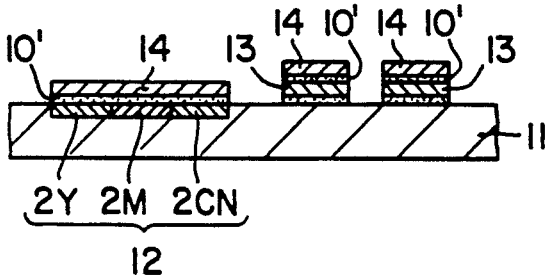
FIG. 16 is a sectional view of a card, as an image receiving sheet to which the image is to be printed, to which is applied heat transfer printing using the heat transfer sheet of FIG. 15.

An example wherein heat transfer to a card is carried out by use of the heat transfer film according to the present invention will be described with reference to FIG. 16.

First, a dye layer 2aof a heat transfer sheet is placed on the surface of a card substrate 11, and a yellow image 2Y is transferred thereto by a thermal printer which is operated in accordance with a color separation signal. A magenta image 2M and a cyan image 2CN are likewise transferred to the same to form a color image 12 as desired. Next, characters, symbols or the like 13 as desired are likewise printed by use of the dye layer 2x of the hot melt ink. Further, a transfer protective layer 2p is used, and the protective layer 2p is transferred onto the color image 12 and/or the image 13 such as character to form a protective layer or layers 14. In this manner, a card as desired is obtained. It is very desirable to form the transfer protective layer 14 on the card. One example of that effect is that when the surface of the card was rubbed 100 times with a gauze impregnated with isopropyl alcohol, the gauze was not at all contaminated. On the other hand, in the case where the protective layer was not transferred, the gauze was badly contaminated in black blown.

In the above-described transfer printing, heads of the thermal printer may be separately (preferably continuously) set for the sublimable transfer, for the transfer of the hot melt ink and for the transfer of the protective layer. These transfers printing may be carried out in a manner such that the respective printing energies are adequately adjusted by a common printer head.

INDUSTRIAL APPLICABILITY

Image receiving sheets to which images are transferred by use of the heat transfer film according to the present invention include, in addition to plastic films such as a polyester sheet, plastic or paper films provided with a dye receiving layer, woven fabrics or non-woven fabrics formed from synthetic fibers such as polyester fiber, polyamide fiber, polypropylene fiber, vinylon fiber, etc., particularly preferably, card substrates formed of polyester resin, vinyl chloride resin or the like. In the case where these card substrates have no sufficient dying properties with respect to the sublimable dye, a dye receiving layer formed of suitable resin can be provided on the surface thereof, or a plasticizer or lubricant can be contained in the resin to provide dye receiving properties. These card substrates may of course be provided in advance with embossment, sign, IC memory, magnetic layer, and other prints.

We claim:

1. A method of heat transfer printing, comprising the steps of providing a heat transfer sheet which comprises a substrate film and heat migratable dye layers of at least one color provided on one surface of said substrate film; heating the dye layers of the heat transfer sheet according to an image signal; and pressing the heat transfer sheet against an image receiving sheet to which an image is to be printed, to heat-migrate the image of the dye of the dye layers to the image receiving sheet, the improvement comprising the steps of providing each of said dye layers in a specific local area of the substrate film, corresponding to a local area of the image receiving sheet in which the image is to be formed; and migrating the dye of the dye layers to said local area of the image receiving sheet, said dye layers including a sublimable dye layer of at least one color and a hot melt ink layer of at least one color.

2. A method of heat transfer printing according to claim 1, wherein the sublimable dye layer is applied to a portion of the substrate film corresponding to an area of the image receiving sheet in which a gradation image is to be formed, and the hot melt ink layer is applied to a portion of the substrate film corresponding to an area of the image receiving sheet in which a monotonic image is to be formed.

3. A heat transfer sheet comprising a substrate film, and heat-migratable dye layers of at least one color provided in a spaced relation on one surface of the substrate film, each of said dye layers being provided in a specific local area of the substrate film corresponding to a local area of an image receiving sheet in which a transferred image is to be formed, said dye layers comprising sublimable dye layers of at least one color and a hot melt ink layer of at least one color.

4. A heat transfer sheet according to claim 3, wherein the sublimable dye layers and the hot melt ink layer are located in areas corresponding to different areas of the image receiving sheet to which the image is to be printed.

5. A heat transfer sheet according to claim 3, wherein each of the sublimable dye layers is applied to a portion of the substrate film corresponding to an area of the image receiving sheet in which a gradation image is to be formed, and the hot melt ink layer is applied to a portion of the substrate film corresponding to an area of the image receiving sheet in which a monotonic image is to be formed.

6. A heat transfer sheet according to claim 3, wherein a peeling layer is provided between the substrate film and the hot melt ink layer.

7. A heat transfer sheet according to claim 3, wherein a peeling layer is provided between the substrate film and the transfer protective layer.

8. A heat transfer sheet according to claim 3, wherein the sublimable dye layers comprise dye layers having at least three colors, yellow, magenta and cyan.

9. A heat transfer sheet according to claim 3, wherein the hot melt ink layer is formed from a black ink layer.

10. A heat transfer sheet according to claim 3, further comprising a transfer protective layer provided on one surface of the substrate film in one of said adjacent areas spaced from the dye layers, the transfer protective layer being present in at least a specific local area of the substrate film corresponding to an area of the image receiving sheet in which the transferred image is to be formed.

11. A method of heat transfer printing, comprising the steps of providing a heat transfer sheet which comprises a substrate film and heat migratable dye layers, for transfer printing of at least one color, applied to successively adjacent areas on one surface of said substrate film at predetermined pitches; heating the dye layers of the heat transfer sheet according to a signal of an image; and pressing the heat transfer sheet against an image receiving sheet to which an image is to be printed, to heat-migrate the image of the dye of the dye layers to the image receiving sheet, the improvement comprising the steps of:

providing each of said dye layers in a specific local area within each of said adjacent areas on the substrate film, said specific local area having an extent to cover only a local area of the image receiving sheet in which the image is to be formed;

heating each of said dye layers within said specific local area in accordance with a signal of an image; and heat-migrating the dye of each dye layer to said local area of the image receiving sheet in accordance with said signal of an image.

12. A method of heat transfer printing according to claim 11, wherein a transfer protective layer is provided on said one surface of the substrate film in one of said adjacent areas spaced from the dye layers, the transfer protective layer being present in at least a specific local area of the image receiving sheet in which the image is to be formed, and the transfer protective layer is transferred to the surface of the image receiving sheet.

13. A method of heat transfer printing according to claim 11, wherein the dye layers are sublimable dye layers.

14. A method of heat transfer printing according to claim 13, wherein each of the sublimable dye layers is applied only to a portion of the substrate film corresponding to an area of the image receiving sheet in which a tone image is to be formed.

15. A heat transfer sheet comprising a substrate film, and heat migratable dye layers, for transfer printing of at least one color, applied to successively adjacent areas on one surface of the substrate film at predetermined pitches, each of said dye layers extending solidly and uniformly in a specific local area within each of said adjacent areas on the substrate film, said specific local area having an extent to cover only a local area of an image receiving sheet in which a transferred image is to be formed.

16. A heat transfer sheet according to claim 15, further comprising a transfer protective layer provided on one surface of the substrate film in one of said adjacent areas spaced from the dye layer, the transfer protective layer being present in at least a specific local area of the substrate film corresponding to an area of the image receiving sheet in which the transferred image is to be formed.

17. A heat transfer sheet according to claim 16, wherein a peeling layer is provided between the substrate film and the transfer protective layer.

18. A heat transfer sheet according to claim 16, wherein the sublimable dye layers comprise dye layers having at least three colors, yellow, magenta and cyan.

19. A heat transfer sheet according to claim 15, wherein the dye layers are sublimable dye layers.

20. A heat transfer sheet according to claim 19, wherein each of the sublimable dye layers is applied to only a portion of the substrate film corresponding to an area of the image receiving sheet in which a gradation image is to be formed.

21. A heat transfer sheet according to claim 15, wherein the dye layers comprise sublimable dye layers of at least one color and a hot melt ink layer of at least one color.

22. A heat transfer sheet according to claim 21, wherein the sublimable dye layers and the hot melt ink layer are located in areas corresponding to different areas of the image receiving sheet to which the image is to be printed.

23. A heat transfer sheet according to claim 21, wherein each of the sublimable dye layers is applied to a portion of the substrate film corresponding to an area of the image receiving sheet in which a gradation image is to be formed, and the hot melt ink layer is applied to a portion of the substrate film corresponding to an area of the image receiving sheet in which a monotonic image is to be formed.

24. A heat transfer sheet according to claim 21, wherein a peeling layer is provided between the substrate film and the hot melt ink layer.

25. A heat transfer sheet according to claim 21, wherein the hot melt ink layer is formed from a black ink layer.

* * * * *